United States Patent [19]

Weintraub

[11] 4,381,692

[45] May 3, 1983

[54] METHOD OF MAKING AN INCENDIARY MUNITION

[75] Inventor: Herbert S. Weintraub, Atherton, Calif.

[73] Assignee: Quantic Industries, Inc., San Carlos, Calif.

[21] Appl. No.: 273,327

[22] Filed: Jun. 15, 1981

Related U.S. Application Data

[63] Continuation of Ser. No. 795,935, May 11, 1977, abandoned, Continuation-in-part of Ser. No. 704,541, Jul. 12, 1976, abandoned.

[51] Int. Cl.[3] ..... F42B 13/14

[52] U.S. Cl. ..... 86/20 B; 102/364; 102/493

[58] Field of Search ..... 29/1.2, 1.21; 86/1 R, 86/20 R, 20 B; 102/364, 493

[56] References Cited

U.S. PATENT DOCUMENTS

| | | | |
|---|---|---|---|
| 1,039,204 | 9/1912 | Sokolowski | 86/1 R |
| 2,183,502 | 12/1939 | Lefere | 102/493 X |
| 3,566,794 | 3/1971 | Pearson | 102/493 |
| 3,830,671 | 8/1974 | McArdie | 102/335 X |
| 3,960,049 | 6/1976 | Smith | 86/20 B |
| 3,961,554 | 6/1976 | Harris | 86/1 R |
| 4,351,240 | 9/1982 | McCubbin et al. | 102/364 |

FOREIGN PATENT DOCUMENTS

| | | |
|---|---|---|
| 133856 | 5/1961 | Sweden . |

*Primary Examiner*—Leland A. Sebastian

*Attorney, Agent, or Firm*—Flehr, Hohbach, Test, Albritton & Herbert

[57] ABSTRACT

A method of making an incendiary munition and product utilizes a quasi alloy zirconium or titanium type incendiary material which is formed either as an inner liner or outer liner of the shell of the munitions body by use of heat and pressure. When used as an inner liner the incendiary material may be engraved by use of a molding process to determine the explosive particulate pattern and fragmentation size of the munition. With proper location of the material in a HEAT warhead it will be ingested into the penetrated unit.

10 Claims, 9 Drawing Figures

METHOD OF MAKING AN INCENDIARY MUNITION

CROSS-REFERENCE TO RELATED APPLICATION

This is a continuation of application Ser. No. 795,935, filed May 11, 1977, now abandoned, which is a continuation-in-part of application Ser. No. 704,541, filed July 12, 1976, now abandoned, entitled "Method of Making An Incendiary Munition and Product Therefor" in the name of Herbert S. Weintraub, and assigned to the present assignee.

BACKGROUND OF THE INVENTION

The present invention is directed to a method of making an incendiary warhead, the resulting product and more particularly where the incendiary material of the warhead is a mixture of metal and epoxy material.

During the Vietnam and Mid East conflicts, it became obvious that fuel fires, whether in ground vehicles or aircraft, can be a significant factor in obtaining a catastrophic kill. The inclusion of incendiaries and other like materials in munitions to obtain fires has resulted in specific rounds of ammunition and warheads being developed to obtain this effect. However, when it was desired to incorporate an incendiary into an existing piece of ammunition to take advantage of the additional incendiary effect, this could not easily be accomplished without a major redesign.

In general incendiaries when used in more typical munitions present serious safety problems. There is a possibility of premature explosion due to the setback effect. For example, if the incendiary material shifts longitudinally during the firing of the munitions, premature detonation can take place. Another safety difficulty is the rotational forces induced in the munitions material due to rifling to cause an angular change again prematurely inducing detonation. Finally, from a storage standpoint, many incendiaries are not compatible; in other words, they are chemically active with respect to explosive materials. If protective coatings are used for the incendiaries then this may raise the foregoing safety problems.

One type of incendiary having the foregoing defects is mishmetal; in fact its use has been banned by a committee of the Department of Defense of the U.S. Government.

As will be discussed in detail below, Quantic Industries, the assignee of the present application has offered for sale for more than a year before the present filing an improved incendiary material of a quasi alloy zirconium type under the trademark QAZ. In use, however, it was only molded into shapes such as booster adapters, fuzes, and spacer rings (which are parasitic components of a munition) and fixed into place as by threading.

OBJECTS AND SUMMARY OF THE INVENTION

It is, therefore, a general object of the present invention to provide an improved incendiary munition.

It is a more specific object to provide a munition as above which particulates in a desired pattern and with a predetermined fragmentation size.

It is another object of the invention to provide an incendiary high explosive antitank (HEAT) warhead where the incendiary material is ingested in the penetrated unit.

In accordance with the above objects there is provided a method of making a munition with a flowable incendiary material comprising a mixture of epoxy and powdered metal including the following steps. A surface of the munition is cleaned. The incendiary material is solidified and bonded to the surface by the use of sufficient heat and pressure. The material is intermolecularly bondable by the heat and pressure to the surface.

DETAILED DESCRIPTION OF THE PREFERRED EMBODIMENT

Figure 1:
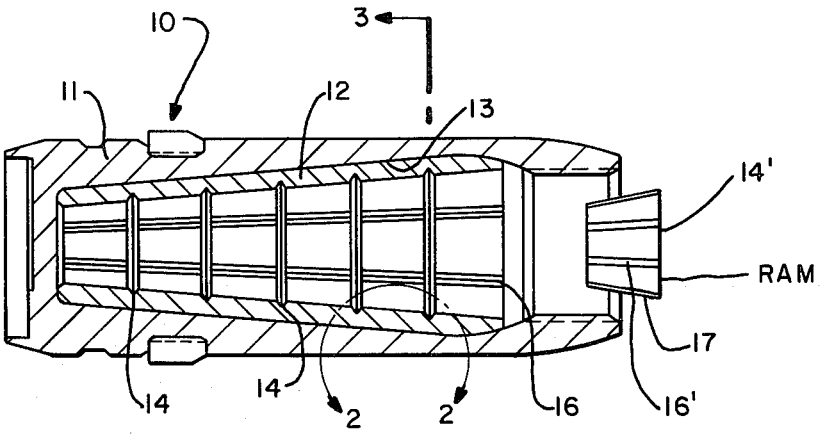
FIG. 1 is a cross-sectional view of an incendiary munition incorporating the present invention.
Figure 2:
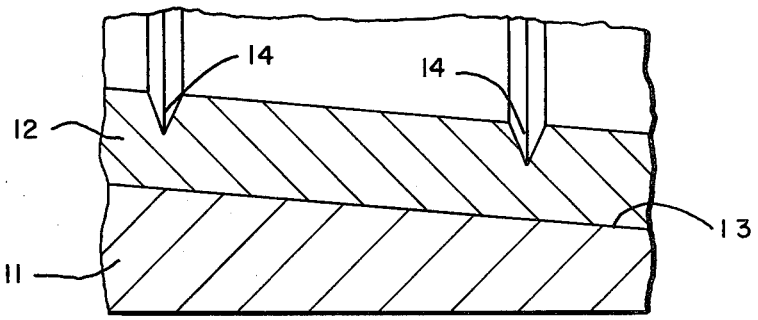
FIG. 2 is a cross-sectional view taken generally along the line 2—2 of FIG. 1.
Figure 3:
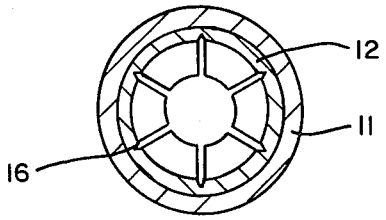
FIG. 3 is a cross-sectional view taken along the line 3—3 of FIG. 1.

FIG. 1 illustrates the metal casing or body 11 of a shell 10 which is lined with an incendiary material 12 which as will be described below is bonded intermolecularly to body 11. This occurs at the interface 13 as illustrated in FIG. 2. As also shown in FIG. 2 there is engraved in the incendiary material lateral grooves 14 and longitudinal grooves 16 which are produced by the pressure ram 17 which is used in the construction of the munition. FIG. 3 is a cross-sectional view showing the longtitudinal grooves 16.

The term munition as used in the present invention includes ammunition, missile warheads and fuzes and the present invention is, of course, applicable to all of these.

Casing 11 is typically of metal and the lining of incendiary material 12 is, in a preferred embodiment, a quasi alloy of zirconium which is offered for sale by Quantic Industries, of San Carlos, Calif. under the trademark QAZ. In general this incendiary material utilizes an epoxy and powdered metal mixture obtained from Hastings Plastics Company of Santa Monica, Calif., under the designation NH74-4. The epoxy is of the long chain type; specifically it is bisphenol epichlorohydrin high molecular weight linearized epoxy. The metal part of the mixture is mainly aluminum with small amounts of antimony, tin and iron. To produce the QAZ material zirconium and hafnium are added to NH74-4 along with a small amount of magnesium, silicone and iron and added aluminum plus very small amounts of the oxides of potassium and calcium. QAZ is a registered trademark of Quantic Industries and is now offered for sale as an incendiary material. Such material is flowable in the form of a thick slurry with a viscosity of several hundred thousand centipoises. Application of heat and pressure will cause it to solidify.

Zirconium is the most significant metal of the mixture but its proportion is relatively non-critical; e.g., the range of 10% to 90% is suitable. The added aluminum may range from 1% to 25% and is also non-critical. The magnesium, iron, and hafnium amounts are adjusted for proper stoichiometric balance with hafnium ranging from 1.5% to 3%, magnesium 100 to 600 parts per million, and iron 200 to 1500 parts per million. In summary the proportions are not critical in achieving the results of the present invention.

An alternate to the NH74-4 is a modified version of Epon 828 or Epon 1001 available from the Shell Chemical Company.

Finally, instead of using zirconium, titanium (another group IV B periodic element) can be substituted. However its proportion must be approximately 3–5% or less because of its higher affinity for epoxy.

The method for forming the munition illustrated in FIGS. 1 through 3 is to first clean the interior surface of metal shell case or body 11 to place it in a sterile condition by the use of, for example trichloroethylene. Next the incendiary material is poured into the body and ram 17, which is engraved with longitudinal ridges 16' and lateral ridges 14', is moved into the body 11 to form the incendiary material 12 as shown. In general, this is done under a pressure of 1,000 psi and at a temperature of 300° F. The temperature is not critical and can range up to 500° F. In addition, depending on the thickness of the incendiary liner 12, the time for the foregoing treatment may vary from 10 to 40 seconds.

With the foregoing method, the incendiary material effectively forms an intermolecular bond at interface 13 with the shell or munition body the material effectively wetting the inner surface of the body. Such intermolecular bond is a totally unexpected effect. It is believed to be a surface effect due partly to the adhesion qualities of the epoxy and also the affinity of the metal portion of the incendiary for the metal shell casing. The bond is so effective that as an alternative to using an engraved ram for forming the pattern the material may be machined. Of course, in this particular embodiment, this would be much more costly. In addition, because of the characteristics of the material and the technique of forming it, the density of the material is uniform throughout with a total absence of any significant voids. This is of crucial importance during use of the munition in order to avoid any setback effect as discussed above. The invention, of course, is equally advantageous in missiles.

Figure 6:
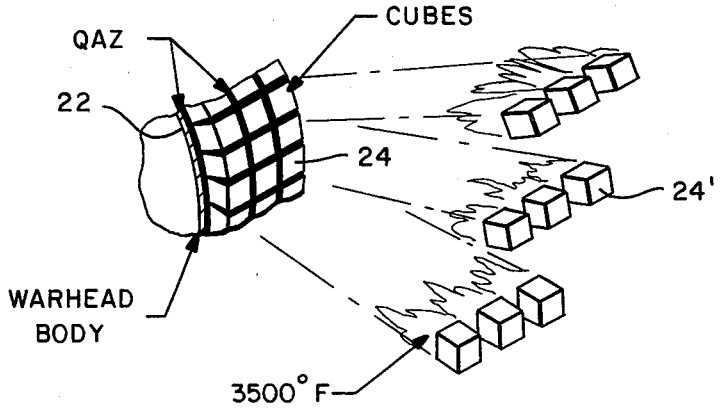
FIG. 6 is an exploded view showing the munition of FIG. 4 after denotation.

Finally, the specific engraved pattern causes the metallic body material 11 to particulate or fragmentate in accordance with the engraved pattern. No other incendiary material is believed to produce this particulating effect which determines both fragmentation size and particle distribution. Thus, an ideal kinetic energy or penetration can be generated depending on the effect desired. And more importantly each metal fragment after detonation of the munition has bonded to it the burning incendiary material as illustrated in FIG. 6. Such burning material provides an increased back pressure for reducing the coefficient of drag of the fragments. This "backburn" principle is well known in general terms. However, it has never been applied to incendiaries because a sufficient bond between the incendiary material and a metal fragment has never been achieved.

In addition to the incendiary material adhering to the shell body it also adheres to nearly all military explosives and is inert to such explosives. No protective coatings are necessary. Thus the explosive, lining and shell body are effectively unitary.

Figure 4:
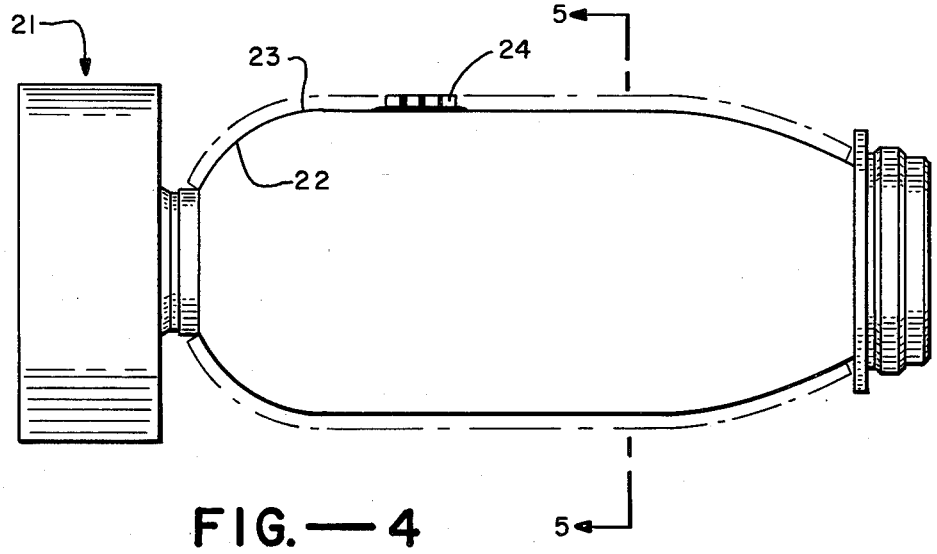
FIG. 4 is a cross-sectional view of another embodiment of the invention.
Figure 5:
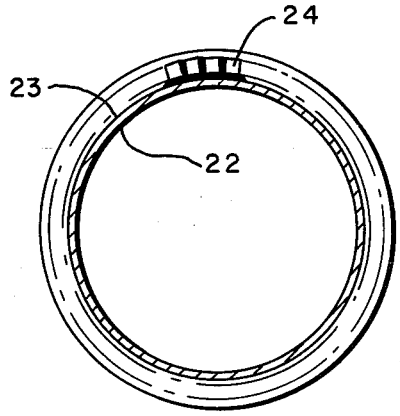
FIG. 5 is a cross-sectional view taken along the line 5—5 of FIG. 4.

FIGS. 4 and 5 illustrate another embodiment of the invention showing a munitions 21 with a shell body 22 and incendiary material 23 being placed on its exterior surface 22. Embedded in the incendiary material are metal cubes or carries 24. These are best illustrated in FIG. 6 and in addition are shown at 24' after detonation with the incendiary material providing a temperature of approximately 3500° F. and providing increased back pressure.

The method of constructing the embodiment of FIG. 5 is first a cleaning and then a coating of the exterior surface with the incendiary material. Thereafter, cubes 24 are embeded and surrounded with a constraining material such as a suitable tape. Next the assembly is placed in a furnace and heated at from 300° to 500° F. The constraint of the tape provides the necessary pressure during the application of heat.

Figure 9:
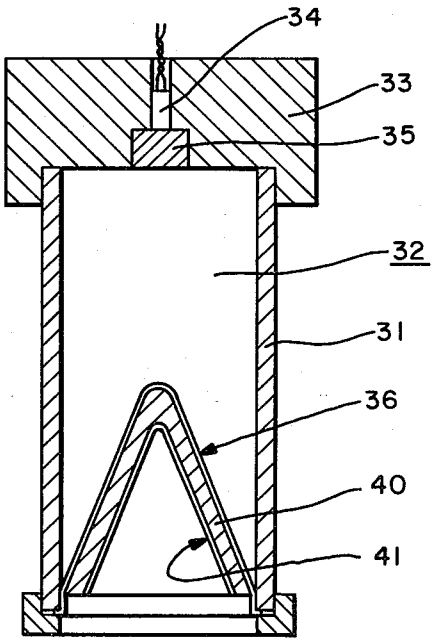
FIGS. 7, 8 and 9 are cross-sectional views of three different embodiments of the invention relating to HEAT munitions.
Figure 8:
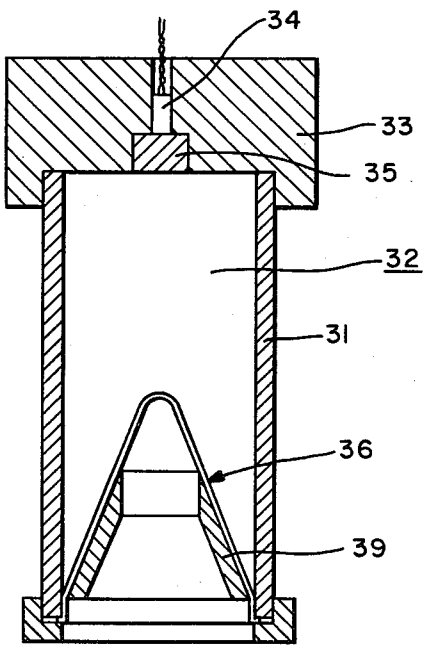
Figure 7:
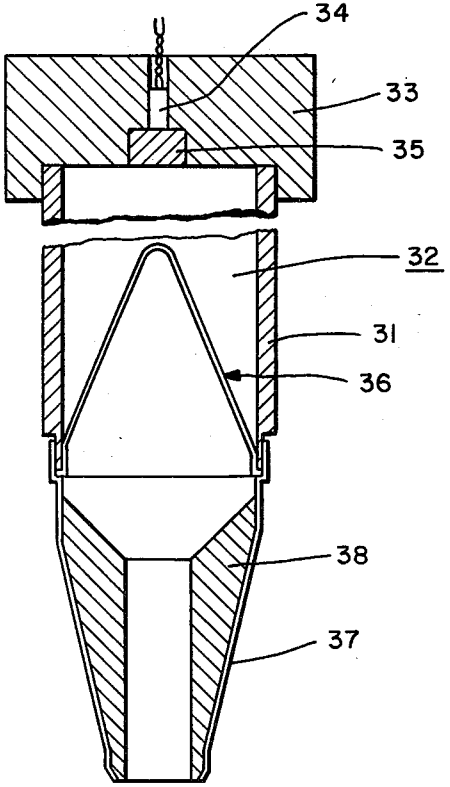

FIGS. 7, 8 and 9 are HEAT warheads each including a body 31 loaded with explosive material 32, and retained on one end by the detonator housing 33 (which includes a detonator 34 and booster 35) and on the other end by a conical precision liner 36.

In FIG. 7 attached to body 31 is a truncated conical nose or ogive 37 which has incredibly material 38 bonded to its interior. An aperture is formed by an appropriate ram along the axis of travel of the warhead.

In FIG. 8 material 39 is bonded to liner 36 and is formed as a truncated cone. Finally, FIG. 9 shows the incendiary material as a full core sandwiched and bonded between liner 36 and a second liner 41.

With all of the configurations of FIGS. 7, 8 and 9 the HEAT warhead when it penetrates a tank or blockhouse will also cause the incendiary material to be ingested. This is especially useful for igniting stored fuel or ammunition.

The phrase "intermolecular bonding" as used herein is defined as a bond between incendiary material and a surface of the munition of such strength that the bond is maintained both during firing of the munition and on detonation. In other words, the material cannot separate from the base metal during setback or after detonation where the burning incendiary material is attached to a fragment of the surface. In effect, the structural integrity between the munition surface and the incendiary material is maintained.

I claim:

1. A method of making a munition with a flowable incendiary material comprising a mixture of epoxy and powdered metal including the following steps: cleaning a surface of the munition; and solidifying and bonding said incendiary material to said surface by the use of sufficient heat and pressure such material being bondable by said heat and pressure to said surface to maintain structural integrity between said munition surface and said incendiary material to prevent the separation of said material from said surface during the occurrence of setback during firing of the munition.

2. A method as in claim 1 where said surface is interior to the body of said munition and including the step of pouring said material into said body and applying said pressure by a ram, said incendiary material being formed with a uniform density without significant voids.

3. A method as in claim 2 where said ram is engraved and forms a predetermined pattern in said material.

4. A method as in claim 2 where a pressure of 1,000 psi is applied by said ram at a temperature of 300° F. for a time period of 10–40 seconds depending on the thickness of said material.

5. A method as in claim 1 where a significant portion of said powdered metal consists of one or more elements from group IV B of the periodic table of elements.

6. A method as in claim 5 where such element is zirconium.

7. A method as in claim 5 where such element is titanium.

8. An incendiary munition made in accordance with the method of claim 1.

9. A method of providing high velocity incendiary fragments by use of a metal shell casing and an incendiary material comprising an epoxy and powdered metal mixture, comprising the steps of, bonding said material to a portion of said casing to maintain structural integrity between said munition surface and said incendiary material to prevent the separation of said material from said surface during the occurrence of setback during firing and to maintain such integrity during exploding, and thereafter exploding said shell casing and igniting said incendiary material to provide a plurality of metal fragments each having a burning incendiary material thereon such burning material providing an increased back pressure for reducing the coefficient of drag of said fragments.

10. A method as in claim 9 including the step of engraving said incendiary material and where in said exploding step said shell casing and bonded incendiary material fragmentate in accordance with said engraving.

* * * * *